US006314743B1

(12) United States Patent
Hutchison

(10) Patent No.: US 6,314,743 B1
(45) Date of Patent: Nov. 13, 2001

(54) CRYOGENIC TEMPERING PROCESS FOR PCB DRILL BITS

(75) Inventor: David C. Hutchison, Rogersville, MO (US)

(73) Assignee: CryoPro, L.L.C., Springfield, MO (US)

( * ) Notice: Subject to any disclaimer, the term of this patent is extended or adjusted under 35 U.S.C. 154(b) by 0 days.

(21) Appl. No.: 09/662,581

(22) Filed: Sep. 15, 2000

Related U.S. Application Data

(60) Provisional application No. 60/153,966, filed on Sep. 15, 1999.

(51) Int. Cl.[7] ..... F25D 25/00; F25D 13/04; C21D 6/04

(52) U.S. Cl. ..... 62/62; 148/577

(58) Field of Search ..... 62/62, 64; 148/577, 148/578, 660, 662, 664

(56) References Cited

U.S. PATENT DOCUMENTS

| | | | |
|---|---|---|---|
| 4,482,005 | 11/1984 | Voorhees | 165/2 |
| 4,739,622 | 4/1988 | Smith | 62/78 |
| 5,044,422 | 9/1991 | Lenker | 165/2 |
| 5,174,122 | 12/1992 | Levine | 62/50.2 |
| 5,259,200 | 11/1993 | Kamody | 62/64 |
| 5,263,886 | 11/1993 | Workman | 445/7 |
| 5,442,929 | 8/1995 | Gillin | 62/62 |
| 5,447,035 | 9/1995 | Workman et al. | 62/62 |
| 5,865,913 | 2/1999 | Paulin et al. | 148/577 |
| 6,056,857 * | 5/2000 | Hunt et al. | 204/192.15 |
| 6,141,974 | 11/2000 | Waldmann et al. | 62/62 |
| 6,164,079 | 12/2000 | Waldmann et al. | 62/62 |

* cited by examiner

*Primary Examiner*—William Doerrler
(74) *Attorney, Agent, or Firm*—Jonathan A. Bay

(57) ABSTRACT

A process for treating carbide tool bits used by the electronics industry for printed circuit board ("PCB") fabrication combines a cryogenic cycle with two or more tempering cycles. The tool bits are subjected to a cryogenic cycle having a ramp down phase during which the tool bits are ramped down in a dry cryogenic environment to about −300° F. over between about six (6) and eight (8) hours, followed by a cryogenic hold phase during which the tool bits are held at about −300° F. over between about twenty-four (24) and thirty-six (36) hours, followed by a cryogenic ramp up phase during which the tool bits are ramped up to about −100° F. over between about six (6) and eight (8) hours. That is followed by a first tempering cycle having a ramp up phase during which the tool bits are ramped up in a dry tempering environment to about 350° F. over about one-half (½) hour, followed by a hold phase during which the tool bits are held at about 350° F. over about two (2) hours, followed by a ramp down phase during which the tool bits are ramped down to below about 120° F. but not generally all the way to the ambient temperature over between about two (2) and three-and-half (3½) hours. A second tempering cycle follows that and it has a time-temperature profile fairly comparable to the first tempering cycle.

11 Claims, 2 Drawing Sheets

CRYOGENIC TEMPERING PROCESS FOR PCB DRILL BITS

CROSS-REFERENCE TO PROVISIONAL APPLICATIONS

This application claims the benefit of U.S. Provisional Application No. 60/153,966, filed Sep. 15, 1999.

BACKGROUND AND SUMMARY OF THE INVENTION

The invention generally relates to carbide bits used in rotary tools by the electronics industry in printed circuit board (hereinafter "PCB") fabrication and, more particularly, to a cryogenic tempering process for extending the useful life of such PCB tool bits.

The representative tool bit of this class is a true drill bit, as used exclusively for axial boring. PCB drill bits range in diameter between about 20/10,000-ths of an inch (0.0020 inches) and ¼-th of an inch (0.250 inches). However, two other members of this class of tool bits for rotary tools of PCB fabrication include: end mills and router bits. None of these three kinds of rotary-tool bits—ie., true drill bits, end mills or router bits—is generally ever any larger than ¼-th of an inch (0.250 inches) in diameter in the PCB fabrication field. Also, they are fairly similar in configuration. For convenience in this description, the phraseology "drill bit" predominantly is used to designate the general class of these tool bits for rotary tools.

Unless the context makes it clear otherwise, there will be only few occasions where the "drill bit" tool bit under discussion is only specifically a true drill bit:—eg., a tool bit used for axial boring only. Again, generally, the phrase "drill bit" as used herein is predominantly non-limiting in that it applies equally as well among true drill bits, end mills and router bits, as used in the electronics industry for PCB fabrication. Thus "drill bit" and "tool bit" are often used interchangeably.

The cryogenic tempering process in accordance with the invention is performed with equipment and machinery which is conventional in the thermal cycling treatment field. First, the articles-under-treatment are placed in a treatment chamber which is connected to a supply of cryogenic fluid, such as liquid nitrogen or a similar low temperature fluid. Exposure of the chamber to the influence of the cryogenic fluid lowers the temperature until the desired level is reached. In the case of liquid nitrogen, this is about −300° F. (ie., 300° F. below zero).

PCB's typically but not exclusively are panels of "fiberglass" which more particularly is a composition of glass and phenolic. Fiberglass as well as other typical compositions used in PCB manufacture simply place high demands on drill bits. PCB material, fiberglass or otherwise, is generally always very abrasive. It dulls drill bits relatively quickly. A drill bit that is dulled until it fails to meet tolerance standards must be immediately replaced. Briefly, as background, the machining operations on PCB'S must be precise and match very close tolerances. For true drill bits or end mills, to give an example, the tolerances are measured in respect of bore diameter, axial straightness, and depth of bore. The PCB's are typically stacked for drilling operations. That way many boards or layers are drilled at once. The stop means provided to stop the depth of the bore is usually formed directly on a true drill bit; it may be a collar that provides a stop shoulder. Such stop collars are located on the drill bits with likewise very exacting tolerances. Typically the span between tip and the shoulder is measured and originally set by a laser device. It is that precise.

Hence, this drilling/fabricating environment not only requires very close precision or tight tolerances, but it is also carried out on a material which is highly abrasive. Accordingly, the majority of tool bits used in this environment are hardened carbide steel so as not to dull as quickly. With conventional carbide PCB drill bits, users are getting between about 500 and 2,000 cycles out of each drill bit before it is so dull it is spent. Spent true drill bits are typically replaced with fresh ones and discarded after being sharpened three times. Re-sharpening router bits and end mills has never proven practical because of cost of sharpening while maintaining tolerances.

What is needed is an improvement which will extend the use life of such PCB tool bits beyond the prior art benchmark of, say, 500 to 2,000 cycles or so.

Certain formats of cryogenic treatment are known for extending the wearability of various steel alloy articles. For instance, the U.S. patent to Nu-Bit, Inc., U.S. Pat. No. 5,259,200—Kamody discloses particular format of a cryogenic treatment for drill bits:—large drill bits.

According to Kamody, the state of the prior art at the time of his invention practiced by the following convention:

> As is apparent from the above description, the time period necessary to complete each step in the cycle of the treatment process generally is a minimum of about an hour per cross-section inch of the article being treated. Thus, for example, treatment of a steel article having a one inch cross-section in the minimum dimension would require a minimum of four hours total to complete the treatment according to generally accepted practices. In a like fashion, an article having a three inch minimum cross-section dimension would require a minimum of twelve hours total to complete the treatment according to the same accepted practices. However, it has been fairly conventional to increase the time periods for each step of the process to ensure that treatment is complete. Thus, for example, many of those practicing the above process routinely provide a safety factor of two or three or more in determining the respective time periods for the steps and as a consequence, overall treatment time periods of up to 50 hours or more for an article having a cross-sectional minimum dimension of one inch are often used. In using such extended time periods for the cryogenic treatment, it is believed that possible stress cracking and distortion of the article are thereby minimized or even eliminated. U.S. Pat. No. 5,259,200.

However, Kamody's personal inventive efforts are directed at reducing such process time.

> Generally, the commercial economics of metallurgical procedures dictate that a particular treatment should be accomplished as quickly as possible so as to minimize the size of the equipment necessary and thus equipment costs as well as requiring less space, energy and inventory in processing.*** Thus, for example, a tool steel article having a minimum cross-sectional dimension of about four inches, the maximum time for treatment [in accordance with Kamody's discovery] of the article in the bath of cryogenic fluid would be about ten minutes. U.S. Pat. No. 5,259,200.

Another format of a cryogenic process for extending the wearability of a steel article is disclosed by U.S. Pat. No. 5,865,913—Paulin et, al., for firearm barrels. This patent for treatment of firearm barrels can be taken as representative of various others still.

In general, cryogenic process is popular for steel alloys because it improves the resistance of metal to normal wear and tear. It is speculated that cryogenic processes affect the wearability of steel by four known mechanisms:—conversion of austenite to martensite; precipitation hardening which may increase Rockwell hardness; formation of fine carbide particles; and residual stress relief. Whether the mechanics are truly known, actual trials on numerous articles bears witness to cryogenics efficacy. Thus, in the case of firearm barrels, "the accuracy of a firearm is directly tied to the heat generated by repeated firing and the wear of the firearm barrel. As the firearm barrels heat up from repeated firing they will warp off axis due to residual stresses in the metal structure. This movement though ever so slight when measured at the muzzle becomes quite significant when measured at a target 200–300 yards away. In addition as the firearm barrels wear, their ability to maintain accuracy is severely diminished. Frequent replacement of conventional firearm barrels and components is necessary, particularly in bench rest shooting, varmint hunting, shooting teams, and the military. Firearm barrels and components treated with the controlled thermal profiling process of this invention have demonstrated that they have reduced residual stresses and increased wear resistance. This allows the firearm barrels and components to be fired with greater accuracy for longer periods of time." U.S. Pat. No. 5.865,913.

However, cryogenic process is laced with problems in aspects of how to best carry it out. For example, from the above-quoted patent on the firearms barrels—U.S. Pat. No. 5,865,913—it gave the warning that "sub-ambient treatments in the past utilized a liquid process which in some cases will cause thermal shock. This is detrimental as it will add stress to the structure." Id.

In U.S. Pat. No. 5,442,929—Gillin, a cryogenic treatment of electrical contacts is disclosed in which, the contacts-under-treatment are enclosed within a sheath, such as a layer of aluminum foil, "to cover the contacting surface and protect the contact from convection currents or other sources of thermal irregularities and to provide a uniform microclimate about the contact." U.S. Pat. No. 5,442,929.

U.S. Pat. No. 5,174,122—Levine, lists compound ways which cryogenic processing can go awry and diminish the wearability of a part rather than extend it. "Some of the problems encountered with the prior apparatus described above arise as follows:—(1 ) delivery of liquid nitrogen to the bottom of the chamber below the payload platform often splashes or splatters the liquid on the payload parts causing extreme thermal shock to the parts that are still relatively warm; (2) the coldest gas in the chamber is just above the liquid and the gas does not flow upward (rise) to the payload parts—the cold gas does not reach the parts until just about all of the gas in the chamber is cold and the coldest gas will always be below the payload parts; (3) pre-soaking the part partially submersed in the liquid nitrogen causes the part to chill unevenly, as the portion of the part that is submersed chills much faster than the portion that is not submersed; and (4) any submersion of the part in the liquid nitrogen results in boiling heat transfer from the part at an excessive rate that does not allow all portions of the part to cool evenly." U.S. Pat. No. 5,174,122.

The foregoing cautions about cryogenic problems are exponentially exacerbated when the article-under-treatment is ultra-small.

Here, the PCB drill bits range in diameter from between about $^{20}/_{10,000}$-ths of an inch (0.0020 inches) and ¼-th of an inch (0.250 inches).

Especially in the smaller sizes, any minute thermal irregularity which might not noticeably affect a drill bit measuring three (3) inches in diameter might just as likely render unfit for its intended use an ultra-small drill bit measuring $^{20}/_{10,000}$-ths of an inch (0.0020 inches) in diameter. For perspective, that diameter is finer than human hair in most instances.

Accordingly, what is needed is a thermal treatment which incorporates a cryogenic process and which provides the advantages obtained but cryogenic process for large articles while avoiding the hazards that endanger the success of cryogenic process when applied to ultra-small articles.

These and other aspects and objects are provided according to the invention in a process for treating carbide tool bits used by the electronics industry for PCB fabrication combines a cryogenic cycle with two or more tempering cycles. The inventive process preferably comprises the following steps.

At the start, carbide tool bits as used by the electronics industry for PCB fabrication resting are found at rest in an ambient environment likely between about 65° F. and 100° F. The tool bits are subjected to a cryogenic cycle having a ramp down phase during which from an initial start time the tool bits are ramped down in a dry cryogenic environment to about −300° F. over between about six (6) and eight (8) hours, followed by a cryogenic hold phase during which the tool bits are held at about −300° F. over between about twenty-four (24) and thirty-six (36) hours, followed by a cryogenic ramp up phase during which the tool bits are ramped up to about −100° F. over between about six (6) and eight (8) hours.

That is followed by a first tempering cycle having a ramp up phase during which the tool bits are ramped up in a dry tempering environment to about 350° F. over about one-half (½) hour, followed by a hold phase during which the tool bits are held at about 350° F. over about two (2) hours, followed by a ramp down phase during which the tool bits are ramped down to below about 120° F. but not generally all the way to the ambient temperature over between about two (2) and three-and-half (3½) hours. A second tempering cycle follows that and it has a time-temperature profile fairly comparable to the first tempering cycle. Optionally, a third tempering cycle can be included too.

The inventive process might have the cryogenic ramp down phase arranged such that it has a varying rate of descent that is more steep initially from ambient to about −100° F. and then more gradual thereafter for temperatures below −100° F. to about the cryogenic hold temperature of about −300° F. The temperature descent from the start time at ambient temperature to the about −100° F. level might be achieved over about the first one (1) hour after the start time. That way, the temperature descent from below about −100° F. to about −300° F. is achieved over between about five (5) and seven (7) hours.

The inventive process might have the cryogenic ramp up phase arranged such that it has a varying rate of ascent that corresponds to an exponential decay of the cryogenic hold temperature from the about −300° F. to about −100° F. over between the about six (6) and eight (8) hours therefor. The exponential decay of the cryogenic hold temperature from the about −300° F. to about −100° F. might transpire such that a temperature of about −200° F. is not reached from the base hold temperature of −300° F. until six (6) hours into the cryogenic ramp up phase, the remaining decay up to −100° F. occurring over a next two (2) hours. Alternatively, the exponential decay of the cryogenic hold temperature from the about −300° F. to about −100° F. might be arranged to transpire such that a temperature of about −200° F. is not reached from the base hold temperature of −300° F. until five-and-half (5½) hours into the cryogenic ramp up phase, the remaining decay up to −100° F. occurring over a next half (½) hour.

Optionally, the cryogenic environment is provided by a Dewar chamber. The tempering environment might be provided by a convection oven. Accordingly, the transition between the cryogenic cycle and first tempering cycle would thus entail physical transfer of the tool bits from Dewar chamber to the convection oven.

A number of additional features and objects will be apparent in connection with the following discussion of preferred embodiments and examples.

BRIEF DESCRIPTION OF THE DRAWINGS

There are shown in the drawings certain exemplary embodiments of the screens for software in accordance with the invention as presently preferred. It should be understood that the invention is not limited to the embodiments disclosed as examples, and is capable of variation within the scope of the appended claims and/or the skills of persons having ordinary skill in the art to which the invention pertains. In the drawings.

DETAILED DESCRIPTION OF THE INVENTION

The cryogenic tempering process in accordance with the invention involves a controlled thermal profile (vis-a-vis ramp-down, hold, and ramp-up phases &c.) for treating the ultra-small carbide tool or drill bits used by the electronics industry in printed circuit board ("PCB") fabrication. While the steps and values of the process, particularly as applied to PCB tool bits, are unique, the deep cryogenic freeze as well as the heat tempering equipment used in the process are known to those skilled in the art and will not be described in detail in the interests of clarity.

PCB tool bits are called on to provide bore holes or machined edges at great precision as measured in respect of bore diameter, depth of bore, as well as axial straightness. The dulling or wearing down of a given tool bit is likely caused by the heat generated by repeated cutting and the erosive wear of the bit as it works on the abrasive matrix of the glass-phenolic composite. As the tool bit heats up from extended use in cutting/drilling strokes, it may anneal and hence soften or may thereafter experience quenching and hence embrittle; it may even warp off axis due to residual stresses in the crystalline or grain micro-structure. But by far the worst is that the tool bit softens and erodes or embrittles and chips in localized places. These deleterious effects compound themselves after extended time. Experience to date throughout the industry finds that conventional PCB drill bits have a use life of between about 500 and 2,000 cycles out of each drill bit before it is so dull it is spent. Spent drill bits are typically replaced with fresh ones and discarded after being sharpened three times. Replacement of spent drill bits costs resources both in terms of labor as well as fabrication line down-time.

However, PCB drill bits treated with the controlled thermal profile of the process in accordance with the invention have demonstrated that they have increased wear resistance. Trials show that this treatment in accordance with the invention extends the wear life of the untreated drill bit by about 1½x factor (eg., from about 500 cycles to 1,250 cycles). This provides economy in workers' time spent attending to the switch-out process of spent drill bits, as well as the associated down-time in the PCB fabrication line while the switch-out transpires. Certainly, the cost-savings realized in reduced consumption of drill bits is a significant cost-savings to the industry. Even though individual the drill bits are relatively affordable (between ~$1.50 and ~$5.00), the savings can be substantial when considering the quantities used (nowadays a modest sized enterprise in the PCB fabrication industry might run through $10,000/week in such tool bits). More surprisingly, significantly further savings will be realized from the diminished time of skilled labor and fabrication line down-time saved for every occasion an array of spent drill bits are not switched out as often as previously.

Figure 1:
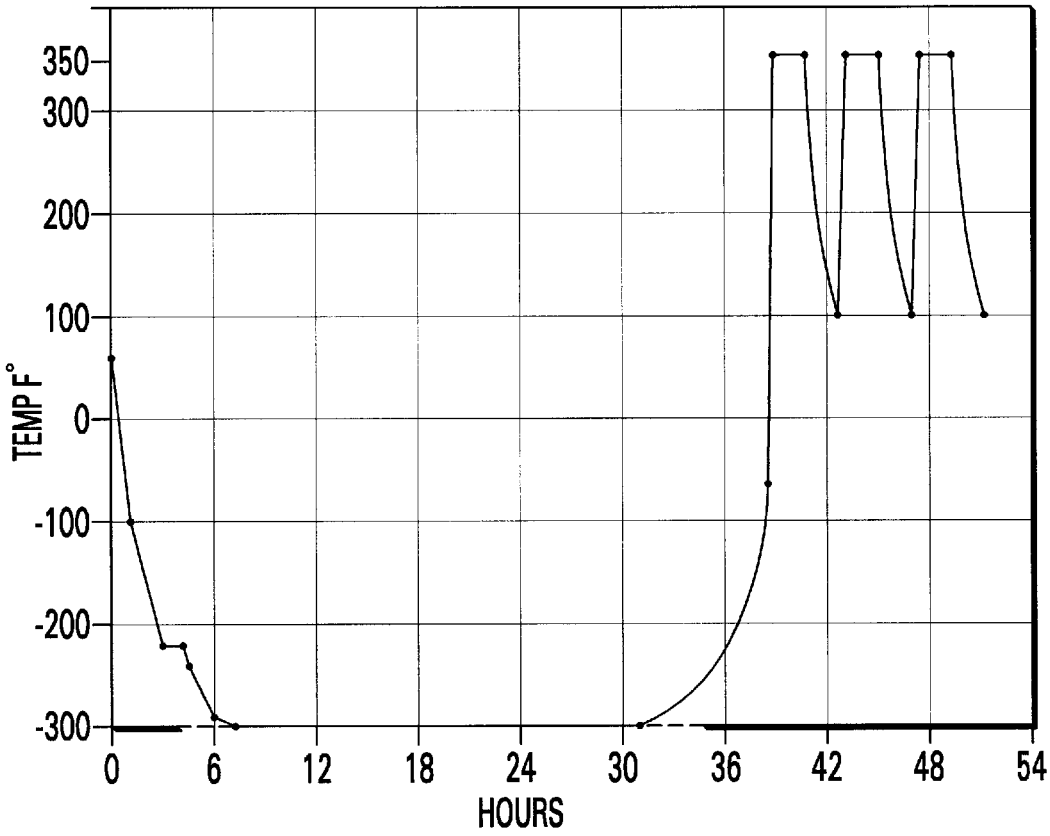
FIG. 1 is a graphical representation of the time-temperature profile for a cryogenic tempering process in accordance with the invention for treating the ultra-small carbide tool bits used by the electronics industry in printed circuit board ("PCB") fabrication; and, FIG. 2 is a comparable graphical representation of the time-temperature profile for an alternative cryogenic tempering process in accordance with the invention for treating the ultra-small carbide tool bits used by the electronics industry in PCB fabrication.
Figure 2:
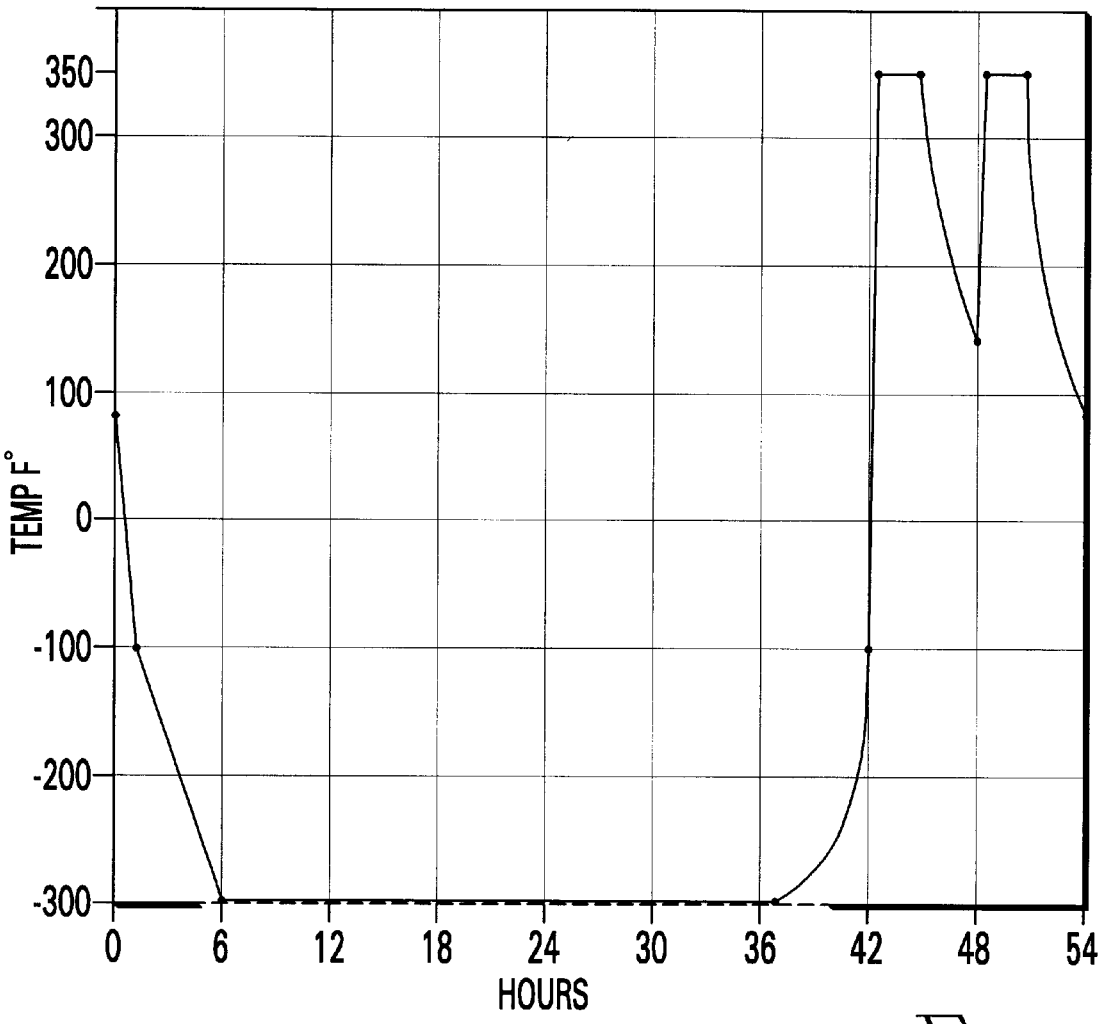

With reference to FIG. 1, one embodiment of a cryogenic tempering process in accordance with the invention comprises both a cryogenic cycle in combination with a set of two or more tempering cycles (eg., three shown in FIG. 1, but see alternatively FIG. 2). The cryogenic cycle of the process generally involves the gradual ramping down, holding, and then ramping up of the temperature of the PCB tool bits to cryogenic temperatures of −300° F. (−185° C.) or lower. The tempering cycles involve plural like cycles up to about 350° F. (177° C.) (again, three cycles shown in FIG. 1).

This cryogenic tempering process in accordance with the invention is accomplished with deep cryogenic freezing and heat treating equipment. The PCB tool bits are placed in a treatment chamber which is connected to a pressurized Dewar and metered feed-line and/or other supply of cryogenic fluid such as liquid nitrogen or the like; liquid nitrogen is preferred. Exposure of the chamber of the cryogenic cooling system lowers the temperature of the PCB tool bits until the desired temperature or temperatures is/are achieved. Control devices of a common nature are employed to ensure that the cooling is gradual as desired. The cooling is intentionally very gradual to avoid stressing the ultra-small diameter payload in the chamber. As stated, the equipment relied on for carrying out the process in accordance with the invention is generally known to those skilled in the art. The tempering of the PCB tool bits can likewise be accomplished in any well-known conventional manner, With renewed interest in the FIG. 1 cryogenic cycle, FIG. 1 shows that the ramp-down phase is accomplished very gradually and with an intermediate shelf before the bottom is reached, and in accordance with a very specific set of parameters of temperature and time. At the frame of reference of initial time (or arbitrarily, time=zero), the PCB drill bits are resting at equilibrium in room temperature, or about 72° F. (22° C.). The following table correlates the target times and temperatures for the process in accordance with the invention. By way of background, a control system is programmed with these parameters. Its temperature measurement for the system is taken from a sensor or probe in the lid of the cryogenic chamber.

| Ramp down phase of Cryogenic cycle | | |
|---|---|---|
| Hour(s) after start | Temperature | Rate (° F./hrs) |
| 1 | −100° F. | 175 |
| 3 | −220° F. | 60 |
| 4 | −220° F. | 0 |
| 5 | −250° F. | 30 |
| 6 | −290° F. | 40 |
| between 7–8 | −300° F. | ~5–10 |

Following the ramp down phase is a "hold phase" in which PCB tool bits are exposed in the deep cryogenic temperatures for an extended period of time. FIG. 1 shows that the duration of the preferred "hold phase" is preferably no less than about twenty-four (24), and more preferentially might be extended up to thirty-six (36) hours and more.

Some of the prior art cryogenic processes in accordance with the prior art literature call this a "soaking" phase, which is certainly technically correct in cases where the payload is immersed in liquid nitrogen. The process in accordance with invention utilizes a dry process. Here the payload is never immersed. Any boiling heat transfer environment which comes with immersion would be too damaging to the delicate PCB tool bits. The entire cryogenic cycle of the process in accordance with the invention can be characterized as "gentle":—gently down, gently hold and gently back up, especially very gently back up.

The liquid nitrogen is introduced into the chamber by means of a nozzle. In fact, in the preferred set up, the supply of the cryogenic fluid comprises a pressurized Dewar of liquid nitrogen. The feed nozzle for feeding the liquid nitrogen into the cryogenic chamber comprises a nozzle mounted in the chamber. The metering device comprises a processor-controlled solenoid valve in the feed line.

By the foregoing means the payload is held at about −300° F. for between about twenty-four (24) and thirty-six (36) hours. During this "hold phase" the metal certainly thermally contracts. It is assumed that the metal's microstructure re-organizes itself to become more spatially uniform. Regardless, trials with the drill bits after completion of the treatment prove that something advantageous happens to them.

Following the "hold phase," there is a correspondingly gradual "ramp up" phase. The cold of the chamber is allowed to decay in accordance with exponential decay such that the temperature ramps up from −300° F. to −100° F. in eight (8) hours. By a straight line method of reckoning the rate of ascent, the rate of ascent would measure as 25° F. or warming each hour. However, as said, the temperature ascends in accordance with an exponential decay curve. The temperature of level of −200° F. is not reached from the base of −300° F. until six (6) hours into the start of the ramp up phase; the remaining warming up to −100° F. occurs over the next two (2) hours. Hence, again by a straight line reckoning method, the warming rate for the first six (6) hours of the ramp up phase measures about 17° F. each hour. For the last two hours, it goes at 50° F. each hour.

It is believed that the rate of ascent plays a singularly substantive role in the measured success of the process in accordance with the invention. It is during this portion of the ramp up phase which all thermal irregularities such as convection currents and the like, are more preferably eliminated than the majority of other times.

The temperature level of −100° F. marks the end of the ramp up phase for the cryogenic cycle. Whereas the temperature continues to ascend, it is reckoned that the next-described ascent belongs to the first (of two or more) ramp up phases of the tempering cycle. In contrast with the cryogenic cycle, where the temperature changes were controlled down to a slow almost snail's pace, there is much quicker movement with the tempering cycle(s).

To begin with, in the physical world, the payload of tool bits is physically transferred out of the cryogenic chest. That is, the payload is loaded into a convection oven provided with a circulating fan. This transfer occurs at the rate of a worker lifting the payload racks out of the chest and placing them in the oven as fast as he or she can in a moderate hurry. As soon as the oven door is shut, the heat and fan start right away. The controller is programmed to ramp up the oven to 350° F. (ie., above zero) in ½ (one half) hour. Again, the temperature measurement which the controller works off of is a probe or sensor mounted inside the oven.

Observations record that frost forms immediately on the tool bits, which cooks off in about ten (10) minutes). Then after 350° F. is reached, the controller then begins to count off a "hold phase" of two (2) hours. Following that, the oven is shut down and the heat is allowed to leak or "decay" away until the temperature in the oven approaches room temperature. In practice, it so happens that the oven used requires two (2) hours or so to fall all the way back to about room temperature.

Arbitrarily, the inventor has chosen the value 100° F. to mark the end of the ramp down or cool down phase for each of the plural tempering cycles. Hence, when the temperature measured in the oven falls to 100° F. or below, the controller cycles the oven for another tempering cycle. Again, the heat is pulsed up to 350° F. in about ½ (one half) hour. The temperature is held at 350° F. for a hold phase of two (2) hours or so duration. Then the oven is switched off and the heat is allowed to decay away to about 100° F. in about another two (2) hours or so. And that completes tempering cycle number 2.

If a third tempering cycle is chosen, then the tempering cycle number 3 follows immediately. The processor is controlled with the same values for cycle number 3 as for number 2, except that at the end of cycle number 3, when the temperature has cooled down to below 100° F., the controller idles itself.

The process in accordance with the invention is complete. The tool bits are ready for retrieval from the oven and thereafter deployment by the end user(s) thereof.

Trials have established that a given superior grade of PCB drill bits which were giving 500 drill strokes untreated before dulling, persisted for about 1,250 cycles after treatment by the process in accordance with the invention. These drill bits cost about $2.00 apiece. They were processed in mass arrays of multiple trays, each tray holding 500 bits apiece, so that a thousand or more were processed as a unit. This accomplishes the necessary economy. The cost investment measured in terms of liquid nitrogen and electric power for the oven only, averages out to a modest amount for each drill bit. Certainly the cost of treatment did not drive up the costs in each drill bit a manifold factor.

As previously stated, some end users are known to have a present budget of $10,000 a week or so for replacement tool bits alone; and these are just modest sized enterprises in the industry. Therefore, the modest extra cost or investment involved with processing drill bits through the treatment process in accordance with the invention promises to highly likely substantially cost justify itself to the industry.

The inventor hereof has applied a pair of processes in accordance with the prior art to PCB drill bits to test the efficacy of the invention. The U.S. Patent of Voorhees, No. 4,482,005, discloses a cryogenic cycle having ramp down and ramp up phases flanking a wet or immersion "soaking" phase. The Voorhees disclosure also asserts that for "tool steel" drill bits, the wet process got a seventeen (17) fold improvement in number of holes between re-sharpening. Applicant finds that its ultra-small, carbide PCB drill bits must be substantially different articles of manufacture than "tool steel" drill bits practiced on by Voorhees. Wet or immersion processes simply prove to be incompatible with the ultra-small, carbide PCB drill bits of the PCB fabrication industry. The quality between one another after wet treatment is too uneven for industry standards. One wet-treated PCB drill bit might have a weak spot where it breaks on a first use. Another wet-treated PCB drill bit might not even reach the use-life level of its untreated counterparts.

The above-referenced U.S. patent to Nu-Bit, Inc., Pat. No. 5,259,200—Kamody discloses a quenching process in which a four-inch diameter steel (not carbide) drill bit is essentially dropped into a liquid nitrogen bath, and let set there for the ten (10) minutes it takes for the liquid nitrogen to boil away. After the bath the drill bits are brought back to room temperature by a jet stream of room-temperature air. This disclosure asserts that, in forty minutes start to finish (including the 10 minute bath), this quick dip method gains up to a fifty fold (50x) improvement in drill bits (again, which may be of a four inch diameter). Applicant has found that submerging ultra-small carbide PCB drill bits in a liquid nitrogen bath, and then directing a jet of air on them after that as disclosed and claimed by Kamody, plainly destroys them.

Whereas applicant 1½ fold improvement factor may at first blush be relatively modest in light of the asserted accomplishments of the prior art, it stands up to measuring as substantial in the use environment in which the work pieces comprise the ultra-small, carbide drill or tool bits of rotary tools used by the electronics industry in printed circuit board (eg., "PCB") fabrication.

To turn now to FIG. 2, it shows an alternate time-temperature profile in accordance with the invention for cryogenic tempering of the ultra-small carbide tool bits used by the electronics industry in PCB fabrication. In FIG. 2, the ramp-down phase is accomplished in two stages which—unlike the FIG. 1 time-temperature profile—are not separated by a shelf. At the frame of reference of initial time (eg., time=zero), the PCB drill bits are assumed resting at equilibrium in room temperature, or about 72° F. (22° C.). The following table correlates the target times and temperatures for the FIG. 2 version of the process in accordance with the invention.***

Ramp down phase of Cryogenic cycle

| Hour(s) after start | Temperature | Rate (° F./hrs) |
|---|---|---|
| 1 | −100° F. | 175 |
| then thru hour 6 | −300° F. | ~40 |

Following the ramp down phase is a "hold phase" in which PCB tool bits are exposed in the deep cryogenic temperatures for an extended period of time. FIG. 2 shows that the duration of the preferred "hold phase" is preferably as extensive as about thirty (3) hours, as between no less than about twenty-four (24), and more preferentially might be extended up to thirty-six (36) hours and more. Again, this "hold phase" is a dry process. The payload is never immersed.

Following the "hold phase," there is a correspondingly gradual "ramp up" phase. The cold of the chamber is allowed to decay in accordance with exponential decay such that the temperature ramps up from −300° F. to −100° F. in six (6) hours. By a straight line method of reckoning the rate of ascent, the rate of ascent would measure as 33° F. or warming each hour. However, as said, the temperature ascends in accordance with an exponential decay curve. The temperature of level of −200° F. is not reached from the base of −300° F. until five-and-half (5½) hours into the start of the ramp up phase; the remaining warming up to −100° F. occurs over the next half (½) hour. Hence, again by a straight line reckoning method, the warming rate for the first five-and-half (5½) hours of the ramp up phase measures about 18° F. each hour. For the last half (½) hour, it ramps up corresponding to about 200° F. per hour.

It is believed that the rate of ascent—particularly for the first half of the ramp up phase (eg., below and up to the −200° F. level)—plays a singularly substantive role in the measured success of the process in accordance with the invention. It is during this portion of the ramp up phase which all thermal irregularities such as convection currents and the like, are more preferably eliminated than the majority of other times.

The temperature level of −100° F. marks the end of the ramp up phase for the cryogenic cycle. Whereas the temperature continues to ascend, it is reckoned that the next-described ascent belongs to the first (of two or more) ramp up phases of the tempering cycle. In contrast with the cryogenic cycle, where the temperature changes were controlled down to a slow almost snail's pace, there is much quicker movement with the tempering cycle(s).

To begin with, in the physical world, the payload of tool bits is physically transferred out of the cryogenic chest and loaded into a convection oven provided with a circulating fan. As soon as loaded, the heat and fan start right away. The controller is programmed to ramp up the oven to 350° F. (ie., above zero) in ½ (one half) hour. Again, the temperature measurement which the controller works off of is a probe or sensor mounted inside the oven.

After 350° F. is reached, the controller then begins to count off a "hold phase" of two (2) hours. Following that, the oven is shut down and the heat is allowed to leak or "decay" away until the temperature in the oven approaches room temperature. The oven is controlled so that after three-and-half (3½) hours, or so the temperature is allowed to decay way down to about a warm temperature of 120° F. or so.

Arbitrarily, the inventor has chosen the value 120 F. to mark the end of the ramp down or cool down phase for the initial one of the plural tempering cycles. Hence, when the temperature measured in the oven falls to 120° F., the controller cycles the oven for another tempering cycle. Again, the heat is pulsed up to 350° F. in about ½ (one half) hour. The temperature is held at 350° F. for a hold phase of two (2) hours or so duration. Then the oven is controlled to have the heat decay away all the way down to about 100° F. in about another three-and-half (3½) hours or so. And that completes tempering cycle number 2 of the FIG. 2 version of the invention.

If a third tempering cycle is chosen (not shown in FIG. 2), then the tempering cycle number 3 follows immediately, wherein cycle number 3 follows with the same values as for number 2, except that cool down to below 100° F. finally marks the end.

The invention having been disclosed in connection with the foregoing variations and examples, additional variations will now be apparent to persons skilled in the art. The invention is not intended to be limited to the variations specifically mentioned, and accordingly reference should be made to the appended claims rather than the foregoing discussion of preferred examples, to assess the scope of the invention in which exclusive rights are claimed.

I claim:

1. A process for treating carbide tool bits used by the electronics industry for PCB fabrication, which combines a cryogenic cycle with two or more tempering cycles, comprising the steps of:

starting with carbide tool bits used by the electronics industry for PCB fabrication resting in an ambient environment likely between about 65° F. and 100° F.;

providing a cryogenic cycle having a ramp down phase during which from an initial start time the tool bits are ramped down in a dry cryogenic environment to about −300° F. over between about six (6) and eight (8) hours, followed by a cryogenic hold phase during which the tool bits are held at about −300° F. over between about twenty-four (24) and thirty-six (36) hours, followed by a cryogenic ramp up phase during which the tool bits are ramped up to about −100° F. over between about six (6) and eight (8) hours;

following that with a first tempering cycle having a ramp up phase during which the tool bits are ramped up in a dry tempering environment to about 350° F. over about one-half (½) hour, followed by a hold phase during which the tool bits are held at about 350° F. over about two (2) hours, followed by a ramp down phase during which the tool bits are ramped down to below about 120° F. but not generally all the way to the ambient temperature over between about two (2) and three-and-half (3-½) hours; and following that with a second tempering cycle having a time-temperature profile fairly comparable to the first.

2. The process of claim 1 wherein the cryogenic ramp down phase has a varying rate of descent that is more steep initially from ambient to about −100° F. and then more gradual thereafter for temperatures below −100° F. to about the cryogenic hold temperature of about −300° F.

3. The process of claim 2 wherein the temperature descent during the cryogenic ramp down phase from the start time at ambient temperature to about −100° F. is achieved over about the first one (1) hour after the start time.

4. The process of claim 3 wherein the temperature descent during the cryogenic ramp down phase from below about −100° F. to about −300° F. is achieved over between about five (5) and seven (7) hours.

5. The process of claim 1 wherein the cryogenic ramp up phase has a varying rate of ascent that corresponds to an exponential decay of the cryogenic hold temperature from the about −300° F. to about −100° F. over between the about six (6) and eight (8) hours therefor.

6. The process of claim 5 wherein the exponential decay of the cryogenic hold temperature from the about −300° F. to about −100° F. transpires such that a temperature of about −200° F. is not reached from the base hold temperature of −300° F. until six (6) hours into the cryogenic ramp up phase, the remaining decay up to −100° F. occurring over a next two (2) hours.

7. The process of claim 5 wherein the exponential decay of the cryogenic hold temperature from the about −300° F. to about −100° F. transpires such that a temperature of about −200° F. is not reached from the base hold temperature of −300° F. until five-and-half (5½) hours into the cryogenic ramp up phase, the remaining decay up to −100° F. occurring over a next half (½) hour.

8. The process of claim 1 wherein:

the tool bits comprise any of true drill bits, end mills or router bits ranging in diameter between about $^{20}/_{10,000}$-ths of an inch (0.0020 inches) and ¼-th of an inch (0.250 inches).

9. The process of claim 1 further comprising a third tempering cycle having a time-temperature profile fairly comparable to the first and second.

10. The process of claim 1 wherein:

the cryogenic environment is provided by a Dewar chamber.

11. The process of claim 10 wherein:

the tempering environment is provided by a convection oven, and transition between the cryogenic cycle and first tempering cycle entails physical transfer of the tool bits from Dewar chamber to the convection oven.

* * * * *

UNITED STATES PATENT AND TRADEMARK OFFICE

CERTIFICATE OF CORRECTION

PATENT NO. : 6,314,743 B1
DATED : November 13, 2001
INVENTOR(S) : David C. Hutchison It is certified that error appears in the above-identified patent and that said Letters Patent is hereby corrected as shown below:

Title page,
Item [22], change "Sep. 15, 2000" to -- Sep. 14, 2000 --

Signed and Sealed this

Twentieth Day of August, 2002

*Attest:*

*Attesting Officer*

JAMES E. ROGAN
*Director of the United States Patent and Trademark Office*